US006597960B2

(12) United States Patent
Spector

(10) Patent No.: US 6,597,960 B2
(45) Date of Patent: Jul. 22, 2003

(54) SPORT CONTEST EQUALIZER SYSTEM

(76) Inventor: Donald Spector, 380 Mountain Rd., Union City, NJ (US) 07087

( * ) Notice: Subject to any disclaimer, the term of this patent is extended or adjusted under 35 U.S.C. 154(b) by 76 days.

(21) Appl. No.: 09/821,585

(22) Filed: Mar. 29, 2001

(65) Prior Publication Data

US 2002/0143412 A1 Oct. 3, 2002

(51) Int. Cl.[7] ..... G06E 155/00; A63B 71/00
(52) U.S. Cl. ..... 700/91; 273/440
(58) Field of Search ..... 700/91, 92, 93; 273/247, 298, 118 R, 440–441, 444, 449–453; 473/470–471, 472, 473, 56–57; 463/43, 44, 49–60, 2–8

(56) References Cited

U.S. PATENT DOCUMENTS 5,125,669 A * 6/1992 Kanda ..... 273/348
5,707,062 A * 1/1998 Perillo et al. ..... 273/354
5,768,382 A * 6/1998 Schneier et al. ..... 380/251
5,976,039 A 11/1999 Epel et al. ..... 473/490
6,017,278 A * 1/2000 Benko ..... 473/70
6,193,610 B1 * 2/2001 Junkin ..... 463/40

* cited by examiner

*Primary Examiner*—Kim Nguyen
(74) *Attorney, Agent, or Firm*—Lieberman & Nowak, LLP

(57) ABSTRACT

This invention provides a game plan that is implemented prior to or in a sporting event to create parity between two mismatched teams in a given competition. A preferred game plan includes a series of counter-measures or tactics so that the burdened team is still free to use its personnel within the established or traditional structure of the game. In one or more alternative embodiments of this invention, parity can be created by alteration in the basic structure or play of the game, for example, creating a hybrid game of an unequal number of players, and scoring rules biased in favor of the inferior team.

4 Claims, No Drawings

SPORT CONTEST EQUALIZER SYSTEM

BACKGROUND OF THE INVENTION

1. Field of the Invention

This invention relates to a system and to a method for orchestrating team sport contests based upon such system. More specifically, this invention relates to a system for leveling the playing field between two mismatched sports teams, in an interactive competition between them, by a series or combination of game rules to reduce the competitive advantage of the better team relative to the inferior team.

2. Description of the Prior Art

The handicapping of individual players of unequal skill, strength or ability is a common practice to make the individuals, who are mismatched in a given competitive contest, more competitive.

Competing Against A Course—For example, in a golf match, the golf course is rated independent of the skill or strength of the players. In addition, men and women generally have different tees from which to hit their drives, the ladies' tees being closer to the hole/greens than the mens' tees. In addition, individual golfers of different skill and ability, will generally have a "handicap" for various rated holes within a golf course to equalize each individual player relative to the rated difficulty (par) of the course. Thus, individual players are allowed to have one or more strokes deducted from their score on a given hole on a specific course, depending upon their handicap and the handicap assigned to a given hole. Notwithstanding, the use of such handicapping system to equalize players relative to a golf match, the individuals are playing against the course, rather than against one another. Thus, whatever competition does exist, the individual skill and effort of each player is directed to bettering his own score or performance, as opposed to preventing his opponent from attaining a lower score for the same hole (e.g. no interactive competition).

Interactive Sports Competition—In contrast to a golf match, the winner in interactive competition is determined by: (a) one competitor scoring more points or goals (e.g., soccer or basketball) than his opponent; and, (b) by limiting the competitor from scoring points or goals. More specifically, the individual or team having the natural or inherent advantage relative to its opponent will generally prevail (win) because it will accumulate more goals or baskets or touchdowns. Thus, the New York Knicks will generally be favored to defeat the NCAA Champion, on any given day, because the skill and talent of the team members, in the aggregate, overwhelm the skill and talent, in the aggregate, of the NCAA Champion. Accordingly, the best that can be hoped for in a mismatch between the Knicks and the NCAA Champion, is that the underdog team will somehow loose by less than expected (the point spread). The point spread is a statistically derived competitive advantage, expressed in terms of a forecast of how many more points or goals the better team shall score over the inferior team.

The point spread affords a wagering opportunity on a sports contest where one team is mismatched relative to another, and the outcome (winner) of the sports event is predictable with a high degree of certainty. Thus, unless an individual fan is also wagering on a sporting event, the spectator interest in such an event is marginal, because the outcome is predicable. Accordingly, even a die hard sports fan has only marginal interest in attending a sporting event to watch his home town team lose, even if the loss is less than expected (the spread). A loss by less than the point spread is no small comfort to the die hard fan that attends these sporting events to root his home team on to victory over the opponent.

When the spectator value for such an event is de minimis, the attendance at venues which host such events, and television revenues for such team competitions, will invariably fall short of expectations, and such sports teams shall fail as viable business opportunities.

Implementation Of Game Rules To Control Player Interactions—In contact sports contests, efforts at limitation or control of the contact between players have been implemented slowly, and primarily to avoid injury to high priced athletic talent. For example, in football, the quarterback is generally accorded a degree of protection when he attempts to run the football by sliding to avoid contact with an opposing player. Similarly, a football punter and punt receiver are each insulated from an on-rushing tackler because of their vulnerability to injury; it being a penalty to rush into the punter without also blocking the kick, and tackling of the punt receiver who calls for the "fair catch."In each instance, the rules of the game are modified to protect a player from injury, without otherwise altering the game dynamics. Where an infraction of the rules occurs, the offending team is penalized within the structure of the game. Notwithstanding, the enforcement of such rules, the game dynamics is not otherwise altered. Thus, each team generally adopts a game plan for each of its offensive and defensive squad, and, unless forced by its opponent to alter such plan, will adhere to such plan in the contest against its opponent: Obviously, the game plan or strategy may change, depending upon its opponents success at scoring or defending against the game plan. The game plan is, however, within the exclusive province of each of the opposing teams; and, thus, each team has exclusive control over the players who take the playing field, the position each player is assigned, the adjustments in its game plan to off-set its opponents strategy, and the match-ups of its players against the players of its opponents. Accordingly, the team that has more talent, both on its starting team and on its bench, will generally prevail in a contest with a less well staffed team.

Implementation Of Game Rules To Alter Game Dynamics—In hockey, referee control over the player interaction, and to enforce rule compliance, is accomplished by assessment of penalties against players for game rule infractions. Unlike football, penalty assessment for hockey rule infractions are calculated to alter the game dynamics. More specifically, the penalized team is generally penalized by the loss of services of the offending player on the ice for anywhere for 3 to 5 minutes, while the opposing team enjoys a man advantage. The mismatch in the number of players can generally result in a score against shorthanded team by the team that suffered the foul. Similarly, if a player is fouled on a breakaway, the fouled player may be accorded a penalty shot on goal. Similarly, in soccer, referee enforcement of the rules and player control is accomplished by "carding" a player for rule infraction, or assessment of a penalty shot. In each of football, hockey and soccer, game rule enforcement is designed primarily to protect players from injury. Accordingly, penalty assessment, in each instance, is not designed to effect the game dynamics, nor to afford an underdog or less competitive team, a level playing field relative to a superior opponent, but rather to preserve referee control over play and to prevent player injury. Assuming the players on each team play within the game rules, the superior team retains its advantage over the inferior team, and the contest result is predictable.

Except in the limited instances set forth above (e.g. assessment of penalties for game rule infractions), there is no comparable mechanism to reduce the effectiveness of a competitor to accord an inferior opponent an improved chance of prevailing in an interactive sports contest wherein each of the teams are mismatched.

A number of systems have been proposed to alter the game dynamics of an interactive sports contest in favor of the less competitive team. The following patent is representative of such a system within the context of the interactive sports of tennis and volleyball.

U.S. Pat. No. 5,976,039 (to Epel, et al., issued Nov. 2, 1999), discloses system and method for handicapping a ball game such as tennis or volleyball between opponents of lesser and greater skills, by varying or moving at least one of the parameters of the court on which the game is played, a sufficient amount to balance the disparity in such skills. The parameters described are the net, and court boundary lines which may be defined by electric luminescent tape embedded in, or fastened to, the surface of the court floor in parallel spaced lines which selectively can be lit to define the desired boundary, or, may be defined by projected lines on or adjacent to the floor from narrow beam or laser beam projectors capable of projecting lines at desired locations either from overhead or at floor level. In the foregoing tennis sport contest environment, the modifications suggested by Epel, et al., only provide some minimal compensation for substantial inequities in skill of the players. The Epel, et al., system and method are apparently focused on ball games such as tennis and volleyball, and presumably, may be applicable to other sports contest with similar playing field constraints.

Notwithstanding, the modifications to physical playing environment proposed by Epel, et al., system and method, historical perspective on the game of tennis has shown the individual effort of a superior player can overcome such "handicapping"—the Bobby Riggs victory over Margaret Court being but one glaring example. Thus, the dominant sports personality will generally remain dominant within his new physical environment, no matter the apparent advantage to his competitor, because of the adaptive nature of the competitive spirit to the new physical environment.

Accordingly, there continues to exist a need to provide a credible means for equalizing competitive interactive sporting events within the constraints of the game, without radical departure from the game rules, or the traditional physical environment, in order to increase the competitiveness of the game contest, and thereby provide the sports fan with the more interesting contest.

Objects of the Invention

It is the object of this invention to remedy the above as well as related deficiencies in the prior art.

More specifically, it is the principle object of this invention to provide a method and system for creating a system for identification of mismatches between members of opposing teams.

It is yet another object of this invention to provide a method and system for creating a system for identification of mismatches among members of competing teams, which system is then used to define a game plan to modify team play, within the traditional structure of the sports contest, and thereby create essential parity between such teams in an interactive sports contest.

Additional objects of this invention include utilizing the system and method of this invention to define a game plan for each team in a contest between them that is based upon mismatches of opposition team members which is calculated to the level the playing field between and thus create a more competitive sports contest.

SUMMARY OF THE INVENTION

The above and related objects are achieved by providing a system and method wherein a group of teams within a given sports category are rated based upon well-known and established handicapping systems to establish a favorite or point spread relative to a competitor within the same sports category. In accordance with this invention, the favored team, in a proposed interactive sports contest, is further analyzed to identify, for example, each of the individual players that excel within the team, and the supporting environment in which their superior performance most frequently occurs. Once having identified such factors, the system would suggest one or more alternatives to neutralize such factors, or, alternatively, to off-set the key factors on the favored team with a series of counter-measures from an opposing team. These factors and counter-measures would be incorporated into a game plan that would govern interactive play between the two opponents for at least a portion of the competition between them.

Thus, for example, an individual player may loose his particular advantage for at least a portion of the contest; and, the favored team would be required to modify its game plan to compensate for the loss of the advantage enjoyed by its exceptional player. For example, in the case where a football team's star receiver was neutralized, the favored team would have to use an alternative receiver, or another series of pass patterns, or resort to its running game to compensate for the loss of such advantage.

Similarly, in a basketball game environment, the dominant player on the favored team could be compromised in terms of his effectiveness, by forcing him out of his preferred zone coverage on defense, or alternatively, denying him (e.g., center) his preferred post position on offense. The loss of his game advantage would thus require him to assume new or additional position responsibility (e.g., a forward or point guard) in the offensive game plan. In each instance, the dominant player or players on the favored team would remain in the game, and play up to their ability in their new position.

The objective of the system and method of this invention could also involve more radical changes to the competitive team structure (e.g., different number of players on each team, limiting the number of plays or minutes a marquee player could play on the favored team, etc.) to create parity among competitors. Because most of these popular interactive, spectator events are contact sports, the selection of equalizing criteria is constrained by the potential for physical injury or abuse, where the number of players on each of the teams is unequal. Notwithstanding, where an unequal number of players is suggested by the system, as a means of creating parity, additional constraints are preferably placed on such extra players to prevent or minimize abuse. For example, if a football team were so over-matched that it needed one or two additional players to create parity, such additional players would preferably only be present on the offensive team where their presence, for example, could increase the chance of completion of a pass, or to provide pass protection for the quarter back in a passing situation. Thus, the opportunity for successful completion of a forward pass would be increased without exposing the opposing (favored) team to potential physical abuse and injury by double teaming a defensive back or safety. Similarly, in the basketball environment, the presence of an additional player would be used sparingly to provide additional offensive scoring. For example, it may be desirable to provide a "designated foul shooter" for a team with a poor foul shot percentage. This designated foul shooter would not replace a regular player, and, if effective, would minimize the "cheap foul" of a player on the underdog team, thereby opening up the lay-up shot possibilities for the underdog team.

In the preferred embodiments of this invention, the system and method of this invention is also applicable to other interactive individual and team sports, and variations on interactive individual and team sports.

DETAILED DESCRIPTION OF THE INVENTION INCLUDING PREFERRED EMBODIMENTS

The system and method of this invention relates to an improvement to traditional handicapping systems involving rating competitive team sport contestants, based upon performance expectations, and the talent of individual team members, to determine both relative strengths and weakness of the competitors. In such traditional handicapping systems, the objective is limited to predicting both the ultimate victor, and the margin of victory.

In the system, the analysis of the competitive advantage of one team over the other goes one step further. More specifically, in addition to performance of a similar evaluation, the system determines the key factors which account for each individual team members contribution to team success or failure, and such factors are graded or assigned a numerical value. Once these key factors are identified, the system then performs a series of computations which defines a game plan which governs the play for both participants to the contest, to thereby neutralize or counter-balance such key factors, which favor one team over the other, to make the contest more competitive. These computations thereby produce a game plan to neutralize mismatches between players on opposing teams, and, changes in the key factors that contribute to the success or failure of each team.

In the implementation of the system of this invention on, for example, a computer based spreadsheet or other comparable data manipulation engine, a value is assigned to each of the opposing team members skills and talents on a numerical scale within a matrix. As noted above, this matrix shall include the key factors that contribute to his success and failure, and the skills and talents of the opposing team member, in much the same way a handicapper performs his analysis in defining the point spread. Once such objective rating is performed, and a computation of the values assigned to each player's talents, shortcomings and the key factors effecting his or her performance, the system postulates a series of game plan scenarios or environmental changes to neutralize the superiority of one or more team players relative to his or her counter-part on the opposing team. These changes in player personnel assignments are part of game plan which, it is emphasized, govern the play of both teams to the contest, and level the playing field (increase competitiveness of the contest) without changing the traditional structure of the game or game play.

The system of this invention can be implemented, for example, on a personal computer running an Excel spreadsheet in which the various key factors are itemized, their respective contribution to various aspects of the game noted and values assigned to the strengths and weakness of the opposing team and/or players on the opposing team factored into the performance of the opposing team. The assignment of such values to each player permits testing of each such factor within a computer game model, to forecast the effect thereof on the individual players performance; and, to identify potential off-sets or counter-measures to create parity between the mismatched teams. The resulting scenarios are, thereafter, incorporated into a game plan that is controlling of the competition much in the same way that the game rules constrain player misconduct. The game plan could be controlling of play between the teams for the entire game or less than the entire game. The artificial parity created by the game plan would, to a degree, be seamlessly integrated into the game play without change in player personnel, or constraints on individual player performance. The environmental factors which would otherwise favor success or failure, are, thus, off-set to a substantial degree, by mismatches in player personnel on the opposing teams, or, alternatively, by restriction on using certain personnel in certain positions.

In one of the embodiments of this invention, the counter-measures or tactics used to place the competitors in parity with one another, are not perceived as handicapping one team in favor of another, in that the burdened team is still free to use its personnel within the established or traditional structure of the game, and each individual team player can still extend himself up to the limits of his ability within the constraints of the game plan. For example, if a superior football team has an exceptional wide-receiver, and the inferior team has an exceptional defensive guard or tackle, one possible game plan scenario would be to pair the exceptional defensive guard or tackle against a less effective offensive lineman. The mismatch at the line of scrimmage would increase the pass rush on the quarterback, giving him less time to throw, and thereby making pass coverage of the wide receiver more manageable (more defensive personnel available for coverage in the secondary on a short pass reception route). Similarly, mismatching the opposing players on special teams (kick off return, field goal, etc.) could also create similar parity. For example, where the favored team had an exceptional kick return specialist, neutralization or minimizing his superior play could be accomplished either by mismatching of his supporting players on the special kick return team with defensive team players; or, by forcing the kick return specialist to play out of position (position himself on the field for a return of a short kick), thereby reducing his contribution to an effective kick return of a long kick.

In another embodiment of this invention, the game plan would address each offensive and defensive pairing of opposing players, approximate their effectiveness in their respective positions relative to their counter-part on the opposing team, and off-set and/or create imbalances in different aspects of the game, to balance the overall offensive play against the overall defensive play. The imbalances, in the aggregate would, thus, minimize any clear advantage the superior team had over its less competitive rival, without inhibiting individual player effort. Notwithstanding such imbalances, the superior team may still prevail, albeit by probably a lesser margin of victory and for different reasons, thereby increasing game interest and fan enthusiasm. Accordingly, the game would be more competitive, without modification of the basis or traditional structure thereof; and, yet still permit superior players to excel by adapting their talents to a game plan that is intended to limit their individual effectiveness.

The game plan could be used to govern play throughout the entire game, or for only a portion thereof. Thus, the inferior team would remain in the game longer and fan interest would be increased. Moreover, the inferior team would not be demoralized by earlier game play, and, thus, could conceivably remain competitive even when the game plan is abandoned in the later stages of the contest. The advantages of this system and method, as applied within the traditional structure of the sports contest, is the preservation of the integrity of the structure of game and fan identification with the event.

In an alternative system of this invention, the established or traditional structure of the competition is modified, thus, creating a hybrid sports competition wherein one or more of the traditional aspects of the game is biased in favor of one of the competitors. More specifically, in one such alternative system, the traditional structure of a competition is modified by fielding an unequal number of players on opposing teams. Unlike the penalty situation in hockey where the penalized team is shorthanded while a team member sits in the penalty box, the imbalances created by having extra players (more than traditionally fielded) is believe to create additional scoring opportunities for an inferior team, and create new defensive challenges for the superior team. The assumption is that the modification of the traditional structure of the competition in such a hybrid sports contest does not change the overall perception of the contest as a sports event, in contrast to the type of comedic exhibitions by the Harlem Globetrotters exhibitions, or a Professional Wrestling Match, which are perceived as something other than an true athletic competition. In such a hybrid competition, a basketball competition could be arranged between an amateur basketball team (e.g. UCLA) to compete against a professional team the (e.g. Los Angeles Lakers). In order to create an artificial parity as above described, each of the team's individual players would be objectively graded relative to his counter-part on the opposing team, and mismatches or imbalances, created as described above. Where parity is still not attainable, the game plan would have to include some modification of the traditional structure of the game (e.g. the point value for a basket scored by the inferior team being greater than the point value score for a comparable basket by the superior team, unequal number of players on each team, etc.). The game plan would, thus, include a series of options to be implemented depending upon the objective grading system used to evaluate the mismatched competitors; and, the choice of options also arranged along some defined hierarchy, with the preferred choice being based upon the desire to avoid or minimize changes in the basic or traditional structure of the game.

In another of the alternative embodiments of this invention, the traditional structure of the game is modified by limiting the team's choice of players eligible to compete against the inferior team. For example, a basketball team with a dominant center would not be permitted to play its dominant center in the center position because of the inferior teams inability to defend against him. The dominant center could still participate as a forward; and, he would be limited to such position throughout game play, or alternatively, only on offense or only on defense.

In yet another alternative embodiment of this invention, each of the competitive teams would compete against one another in a sport other than in their professional sport. Thus, a football team would compete against another football team by playing a basketball competition. The entertainment value of the latter, as a sporting event, would probably be marginal, although the fan interest could be generated if such a competition occurred on a limited basis; and, did not otherwise count in the professional ranking of the team in its chosen profession.

What is claimed is:

1. A method for creating parity between live team competitors prior to or during an interactive competition wherein said teams are unequally matched, said method comprising:

providing an objective matrix for grading members of two opposing teams scheduled to engage in a team competition, wherein individual team members of each team, or the entire team, are rated on a common scale relative to factors effecting performance, including factors relative to other team members on said individual's own team, and factors relative to a counter-part on said opposing team;

assigning a value to such rating of said individual team member or team;

assessing an individual member's contribution to his or her team's effort relative to said opposing team within a game plan, based upon said individual or team's rating relative to members on said opposing team;

adjusting said game plan on the basis of said individual members or team's rating to control interactive play between said teams prior to or during said interactive competition; and wherein said adjusted game plan assigns players of one of the opposing teams to positions of play other than their favored or preferred positions.

2. The method of claim 1, wherein said game plan alters the number of players by permitting unequal numbers of players on said opposing teams.

3. The method of claim 1, wherein said game plan controls said competition between said teams for the entire contest.

4. The method of claim 1, wherein said game plan controls said competition between said teams for less than the entire contest.

* * * * *